US006883678B2

(12) United States Patent
Chou

(10) Patent No.: US 6,883,678 B2
(45) Date of Patent: Apr. 26, 2005

(54) FOOD CONTAINER SEALING STRUCTURE

(76) Inventor: Hsin-Hung Chou, No. 2, Alley 2, Lane 250, Wen Chang Street, Taipei City (TW)

( * ) Notice: Subject to any disclaimer, the term of this patent is extended or adjusted under 35 U.S.C. 154(b) by 186 days.

(21) Appl. No.: 10/127,439

(22) Filed: Apr. 23, 2002

(65) Prior Publication Data

US 2003/0197021 A1 Oct. 23, 2003

(51) Int. Cl.[7] ..... B65D 51/16

(52) U.S. Cl. ..... 220/793; 220/4.21; 220/789; 220/798; 220/801; 220/781; 220/380

(58) Field of Search ..... 220/4.24, 380, 220/787, 794, 796, 801, 780, 781, 783, 784, 790, 791, 793, 789, 4.22, 4.21, 797, 798; B65D 51/16

(56) References Cited

U.S. PATENT DOCUMENTS

| | | | | | |
|---|---|---|---|---|---|
| 2,798,631 | A | * | 7/1957 | Engel | 220/4.21 |
| 3,320,993 | A | * | 5/1967 | Motsenbocker | 220/780 |
| 3,420,397 | A | * | 1/1969 | Miller | 220/203.09 |
| 3,454,158 | A | * | 7/1969 | Tigner | 206/471 |
| 3,676,159 | A | * | 7/1972 | Fallowfield | 206/205 |
| 4,180,179 | A | * | 12/1979 | Hoenig et al. | 220/783 |
| 4,836,407 | A | * | 6/1989 | Bruce et al. | 220/276 |
| 4,944,134 | A | * | 7/1990 | Grindrod et al. | 53/432 |
| 5,377,860 | A | * | 1/1995 | Littlejohn et al. | 220/790 |
| 5,398,908 | A | * | 3/1995 | Kienle | 249/121 |
| 6,168,044 | B1 | * | 1/2001 | Zettle et al. | 220/784 |
| 6,315,151 | B1 | * | 11/2001 | Hupp et al. | 220/666 |
| 2002/0175164 | A1 | * | 11/2002 | Dees et al. | 220/4.24 |
| 2002/0175171 | A1 | * | 11/2002 | Stewart et al. | 220/781 |

FOREIGN PATENT DOCUMENTS

| | | | | |
|---|---|---|---|---|
| EP | 33266 A1 | * | 8/1981 | B65D/43/02 |
| EP | 790934 B1 | * | 6/2001 | B65D/1/26 |

* cited by examiner

*Primary Examiner*—Lee Young
*Assistant Examiner*—James Smalley
(74) *Attorney, Agent, or Firm*—Rosenber, Klein & Lee

(57) ABSTRACT

A food container sealing structure is constructed to include a container body having a peripheral coupling flange, and a cover having a peripheral coupling flange coupled to the coupling flange of the container body to seal the container body, the coupling flange of the container body having endless concave portions respectively formed in horizontal section and vertical section thereof, the coupling flange of the cover having endless convex portions respectively formed in horizontal section and vertical section thereof and respectively engaged into the endless concave portions of the container body.

1 Claim, 10 Drawing Sheets

FOOD CONTAINER SEALING STRUCTURE

BACKGROUND OF THE INVENTION

1. Field of the Invention

The present invention relates to food containers and, more particularly, to a food container sealing structure, in which the coupling flange of the container body has endless concave portions extended around the container body and arranged at right angles, and the coupling flange of the cover has endless convex portions extended around the cover and arranged at right angles for engaging the endless concave portions of the coupling flange of the container body to seal the container body.

2. Description of the Related Art

Vacuum-formed plastic containers are commonly made in the form of a box, cup, or bowl for use to keep food fresh. When carrying fluid, jelly-like, or liquid food in a plastic container, the container must be sealed, preventing a leakage of contained food. FIG. 1 shows a cup-like plastic food container 1 according to the prior art. The cup-like plastic food container 1 comprises a cup body 11 holding a liquid food 12, and a film covering 13 of aluminum foil or plastic film sealed to the top open side of the cup body 11. When opened the film covering 13, the film covering 13 cannot be sealed to the cup body 11 again. FIG. 2 illustrates another structure of plastic food container 2 according to the prior art. According to this design, the plastic food container 2 comprises a cup body 21, and a cover 22 sealed to the top open side of the cup body 21. The cup body 21 has a coupling flange 211 extended around the top opening. The cover 22 has a peripheral coupling flange 221 coupled to the coupling flange 211 of the cup body 21. If the plastic food container 2 is used to hold a liquid food 23, a heat sealing apparatus or the like must be used to seal the coupling flanges 211;221. When sealed, the user must use a scissors or cutter means to open the cover 22. When opened, the cover 22 cannot be sealed to the cup body 21 again.

FIGS. 3 and 3 show a food container 3 constructed according to U.S. Pat. No. 6,056,138, entitled "TRIPLE SEAL CONTAIENR". According to this design, the food container 3 comprises a container body 31 and a cover 32 covered on the container body 31. The cover 32 is made from plastics by a vacuum-forming machine, having a flange 321 extended around the periphery and a locking lip 322 protruded from the free end of the flange 321. When attaching the flange 321 of the cover 32 to the rim 311 of the container body 31, the locking lip 322 is hooked on the free end of the rim 311 of the container body 31. This design of food container is still not satisfactory in function. The main drawbacks of this design of food container are as follows:

1. When opening the cover 31, the user must use the fingers to disengage the locking lip 322 from the rim 31 of the container body 31. When pulling the locking lip 322 away from the rim 311 of the container body 31 with the fingers, the locking lip 322 may injure the fingers.

2. When the cover 32 closed on the container body 31, a gap 34 is left in the connection area 33 between the flange 321 of the cover 32 and the rim 311 of the container body 31. If the food container falls down, contained liquid food may leak out of the food container 3 through the gap 34.

SUMMARY OF THE INVENTION

The present invention has been accomplished under the circumstances. It is therefore the main object of the present invention to provide a food container, which is resealable. It is another object of the present invention to provide a resealable food container, which can easily safely be opened with the fingers without tools. To achieve these and other objects of the present invention, the food container sealing structure comprises a container body, and a cover adapted to seal the container body. The container body has a coupling flange extended around the rim thereof. The cover has a coupling flange extended around the rim thereof and adapted for coupling to the coupling flange of the container body. The coupling flange of the container body has endless concave portions respectively formed in horizontal section and vertical section thereof. The coupling flange of the cover has endless convex portions respectively formed in horizontal section and vertical section thereof and adapted for engaging into the endless concave portions of the container body respectively.

DETAILED DESCRIPTION OF THE PREFERRED EMBODIMENT

Referring to FIGS. from 5 through 8, a food container A is shown comprised of a container body 4 and a cover 5. The container body 4 and the cover 5 are respectively made from plastics by a vacuum forming machine or injection molding machine. The cover 5 may be made transparent. The container body 4 can also be made transparent. Either transparent or opaque, the container body 4 and the cover 5 have a thin wall thickness suitable for keeping food in fresh. The sealing arrangement of the food container A does not increase the dimensions or interfering with the convenience of the use of the food container A.

Figure 7:
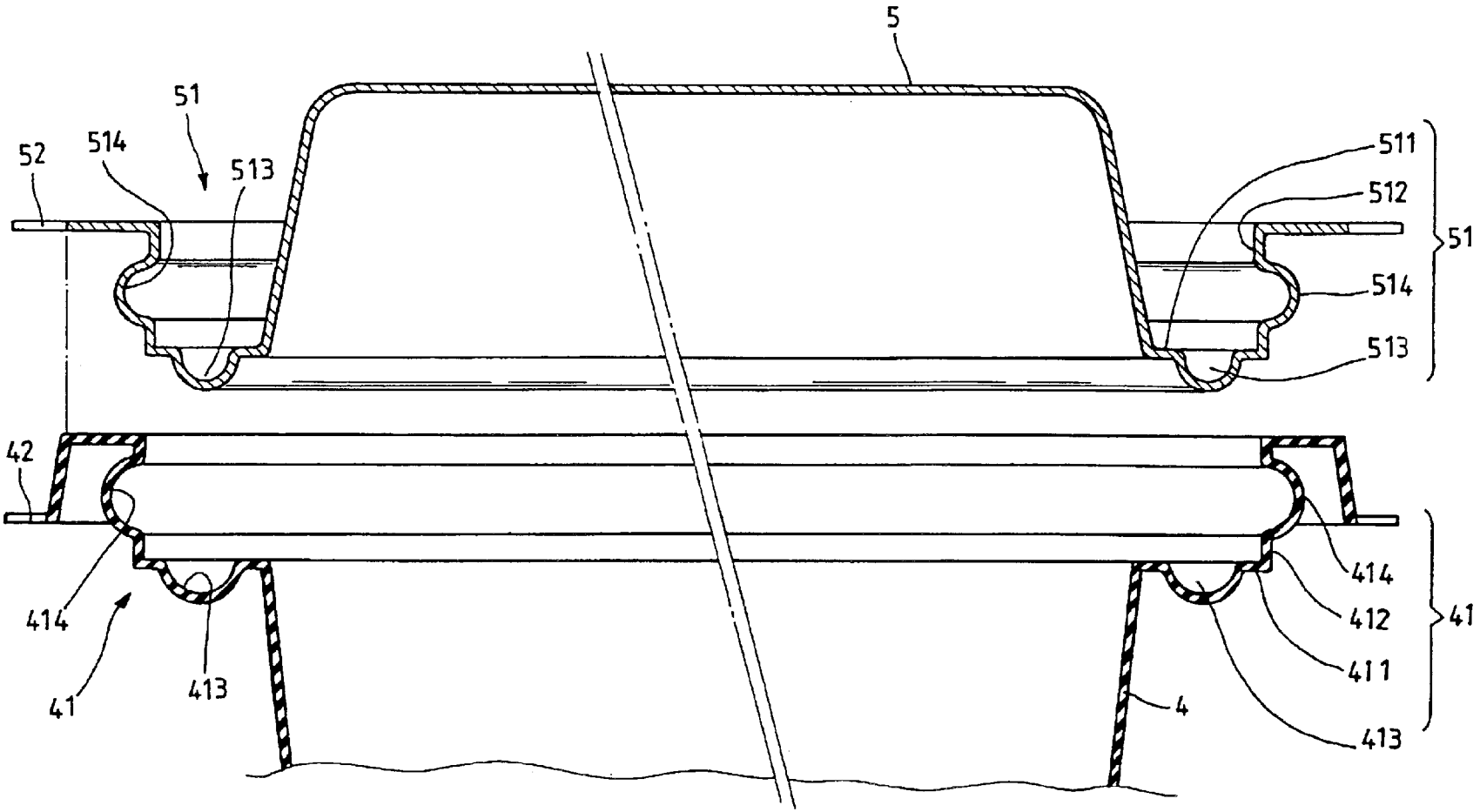
FIG. 7 is a sectional view in an enlarged scale of FIG. 5.
Figure 8:
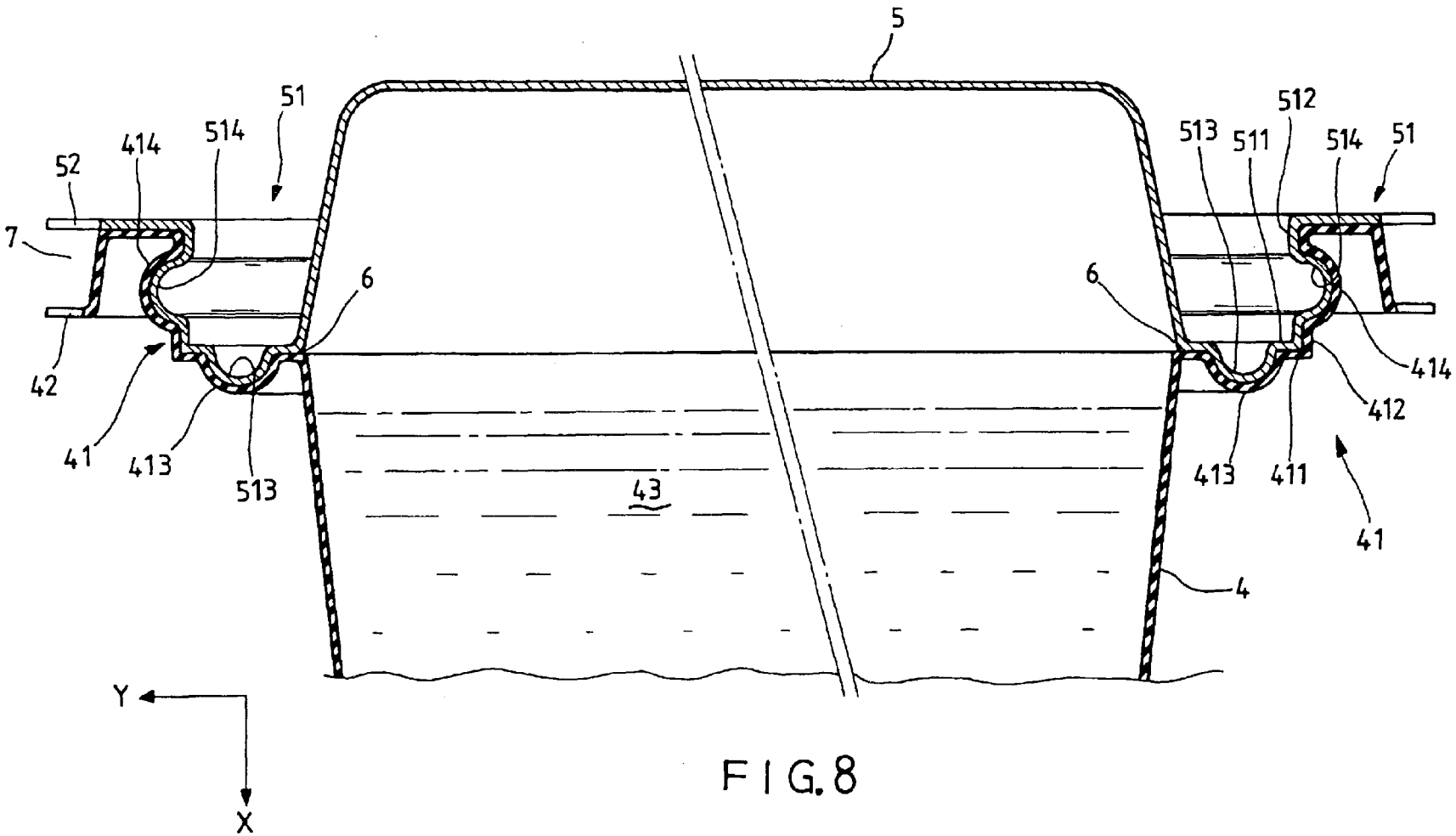
FIG. 8 is a sectional view in an enlarged scale of FIG. 6.

The container body 4 has a coupling flange 41 extended around the rim thereof. As illustrated in FIG. 7, the coupling flange 41 of the container body 4 comprises a horizontal section 411 and a vertical section 412 arranged at right angles, a first endless concave portion 413 formed in the horizontal section 411 at an upper side and extended around the container body 4, and a second endless concave portion 414 formed in the vertical section 412 at an inner side and extended around the container body 4.

The cover 5 has a coupling flange 51 extended around the rim thereof and adapted for coupling to the coupling flange 41 of the container body 41. The coupling flange 51 of the cover 5 comprises a horizontal section 511 and a vertical section 512 arranged at right angles, a first endless convex portion 513 formed in the horizontal section 511 at a bottom side and extended around the cover 5, and a second endless convex portion 514 formed in the vertical section 512 at an outer side and extended around the cover 5.

When the cover 5 vertically closed on the container body 4, the first endless convex portion 513 and second endless convex portion 514 of the cover 5 are respectively press-fitted into engagement with the first endless concave portion 413 and second endless concave portion 414 of the container body 4, and therefore the food container A is well sealed. Because the first endless convex portion 513 curves in X-axis direction and the second endless convex portion 514 curves in Y-axis direction, they restrain each other. Therefore, when the first endless convex portion 513 and second endless convex portion 514 of the cover 5 are respectively press-fitted into engagement with the first endless concave portion 413 and second endless concave portion 414 of the container body 4, the tension force of the cover 5 keeps the horizontal section 511 and vertical section 512 of the cover 5 closely attached to the horizontal section 411 and vertical section 412 of the container body 4 to seal the gap in the coupling area 6 between the cover 5 and the container body 4, preventing contained liquid food 43 from leaking out of the container body 4. This container sealing arrangement prevents leakage of contained liquid food 43, keeping contained liquid food 43 in fresh for a period of time.

The aforesaid endless concave portions 413;414 and endless convex portions 513;514 preferably have a semicircular cross section. This semicircular cross section design reinforces the structural strength of the coupling flanges 41;51, and enables the endless convex portions 513;514 to be easily engaged into the endless concave portions 413;414.

Figure 1:
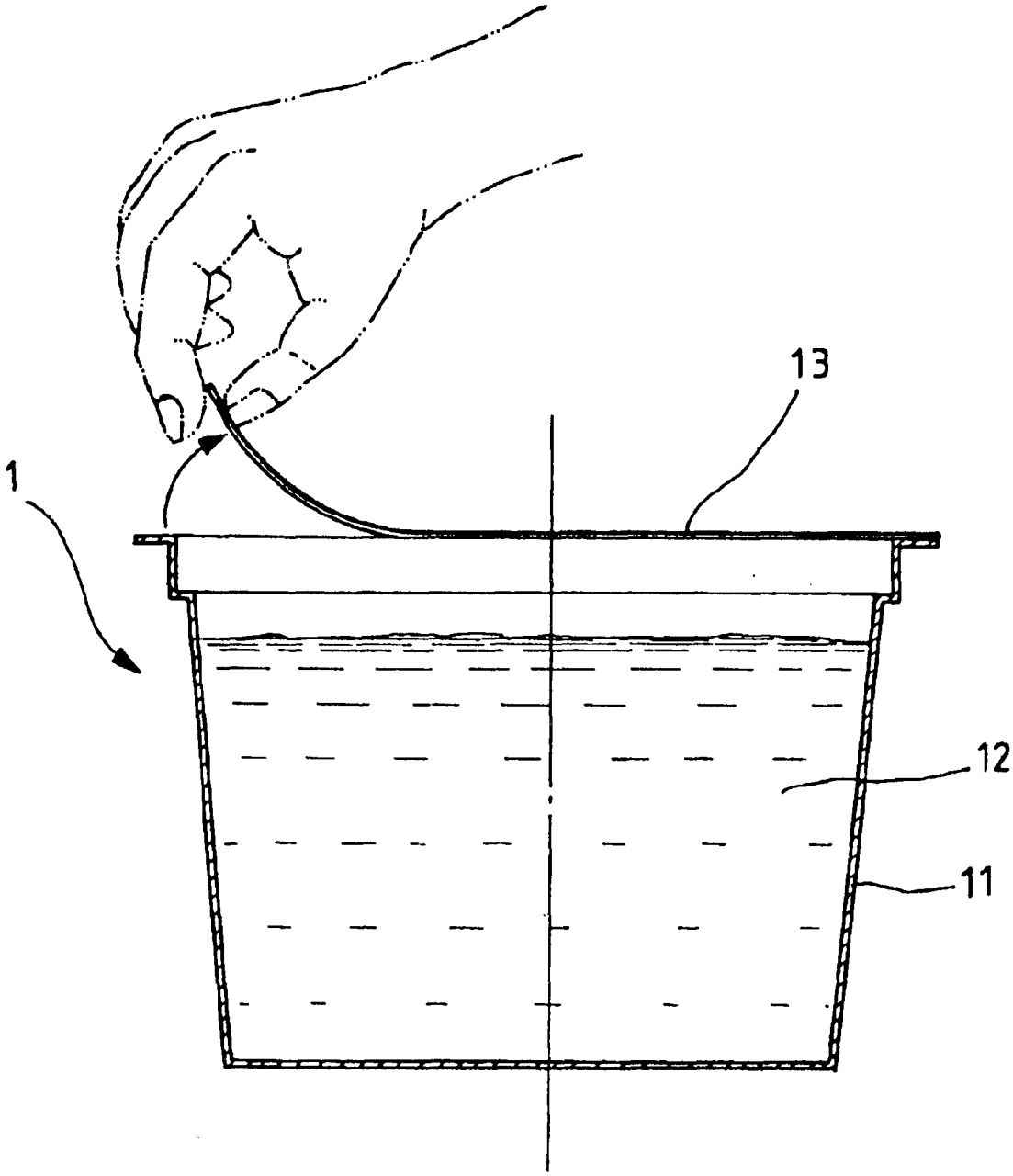
FIG.1 PRIOR ART
FIG. 1 illustrates a food container constructed according to the prior art.
Figure 2:
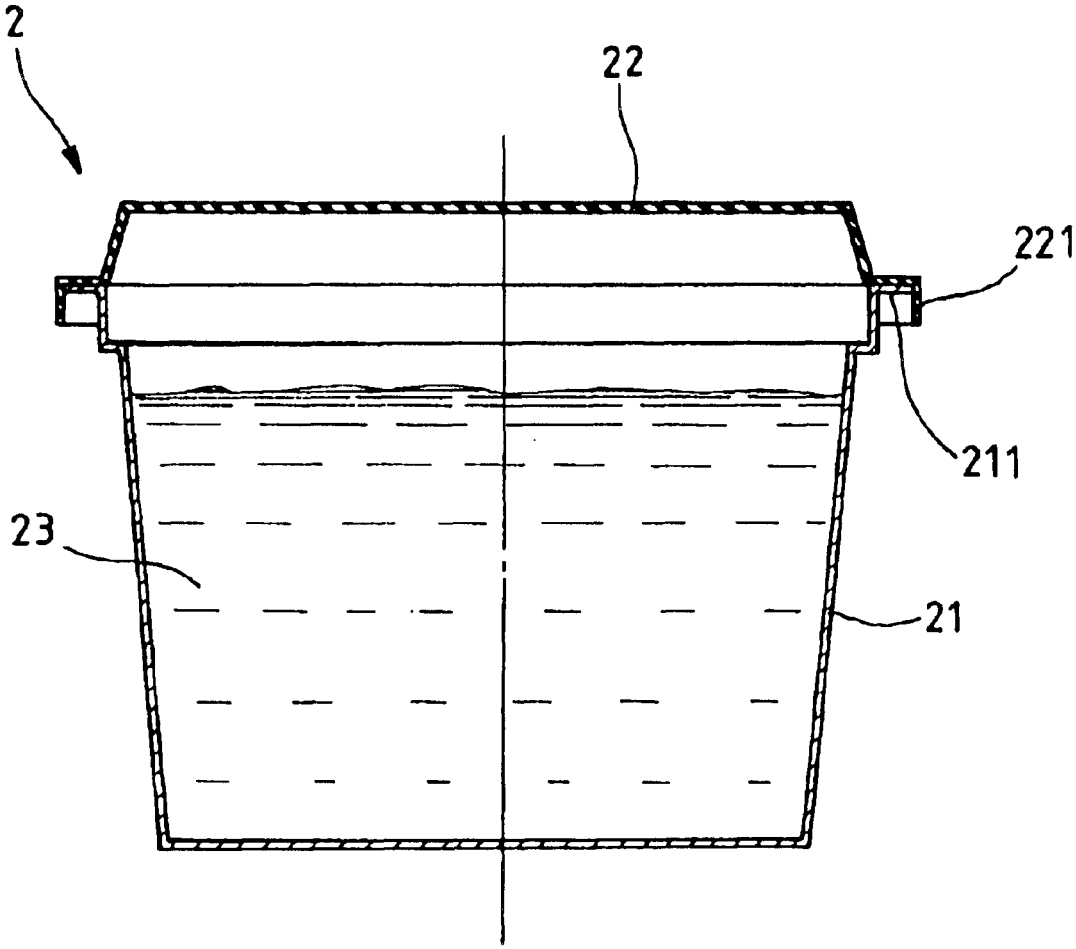
FIG.2 PRIOR ART
FIG. 2 illustrates another structure of food container according to the prior art.
Figure 3:
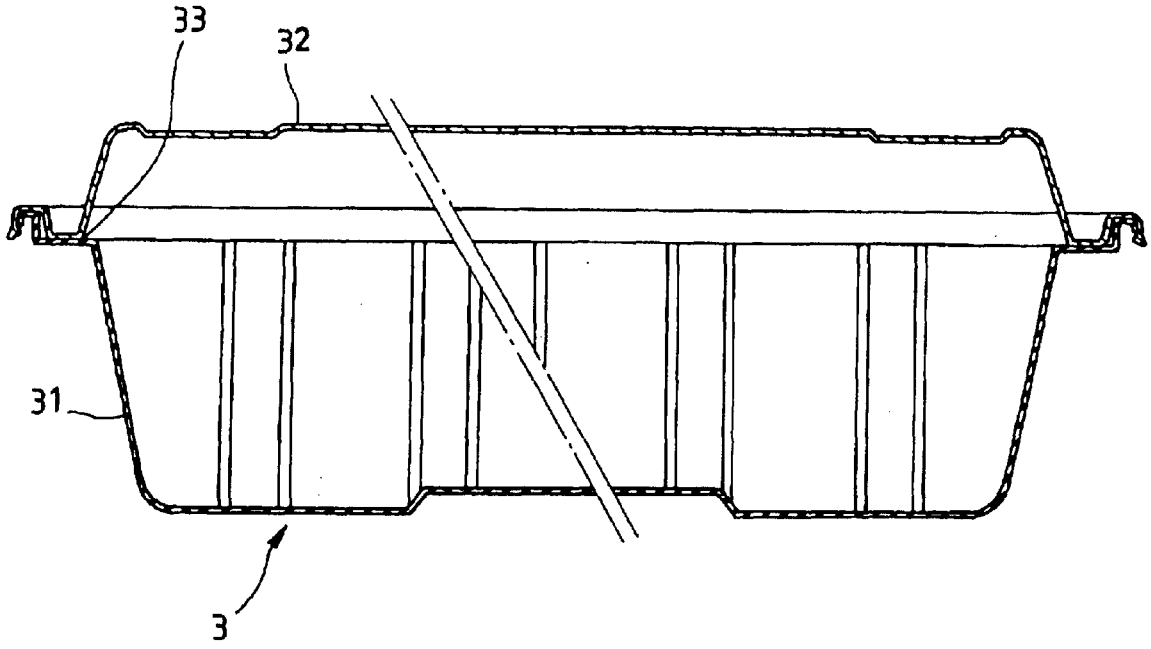
FIG.3 (PRIOR ART)
FIG. 3 is a sectional view of a food container constructed according to U.S. Pat. No. 6,056,138.
Figure 4:
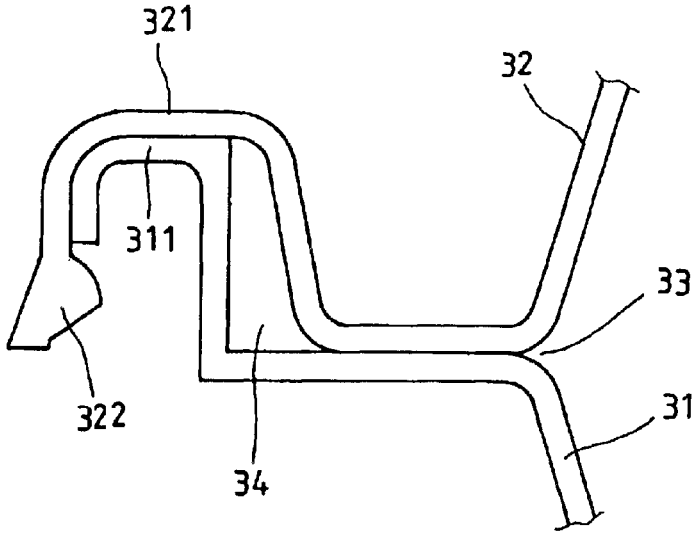
FIG.4 (PRIOR ART)
FIG. 4 is an enlarged view of a part of FIG. 3.
Figure 5:
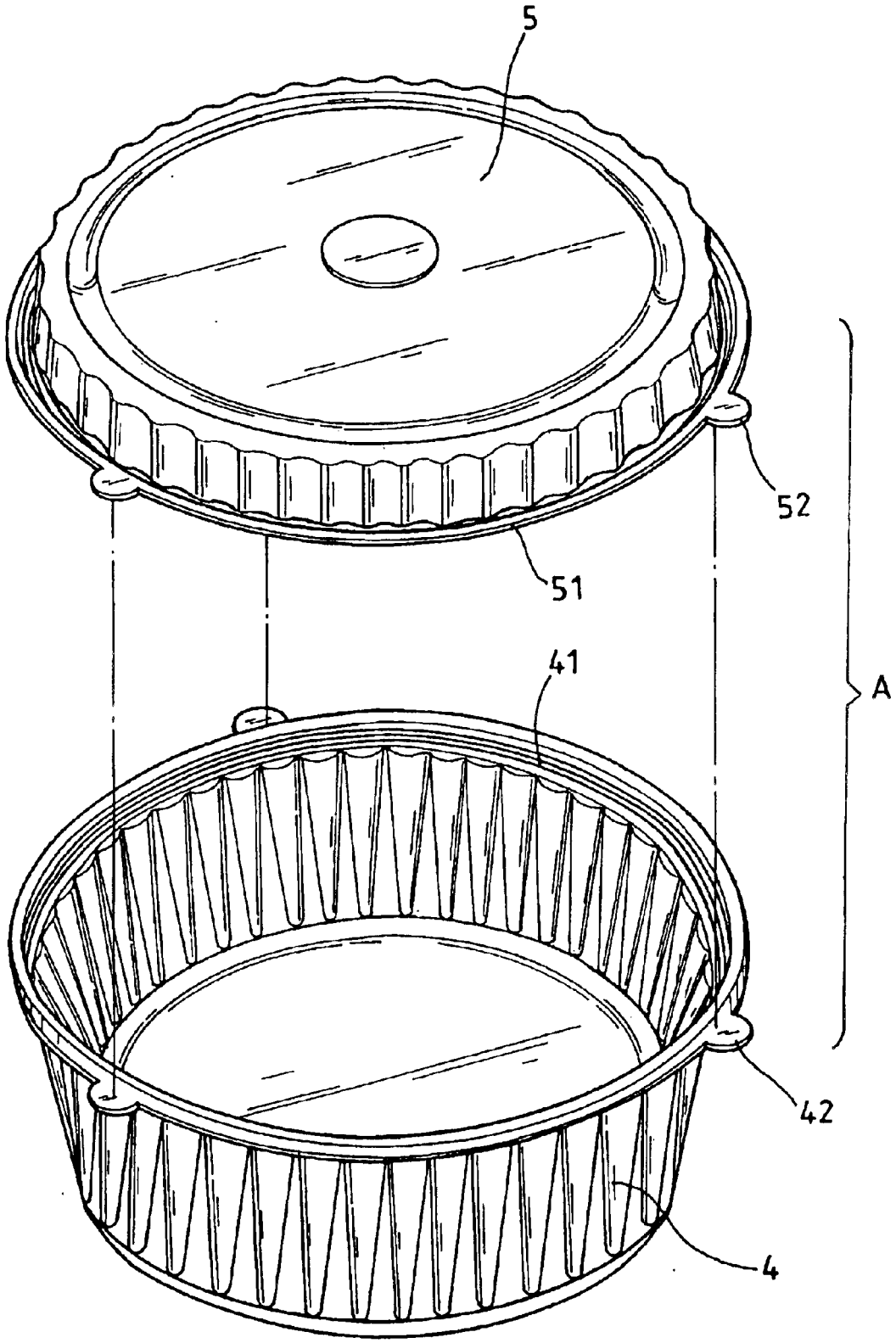
FIG. 5 is an exploded view of a food container according to a first embodiment of the present invention.
Figure 6:
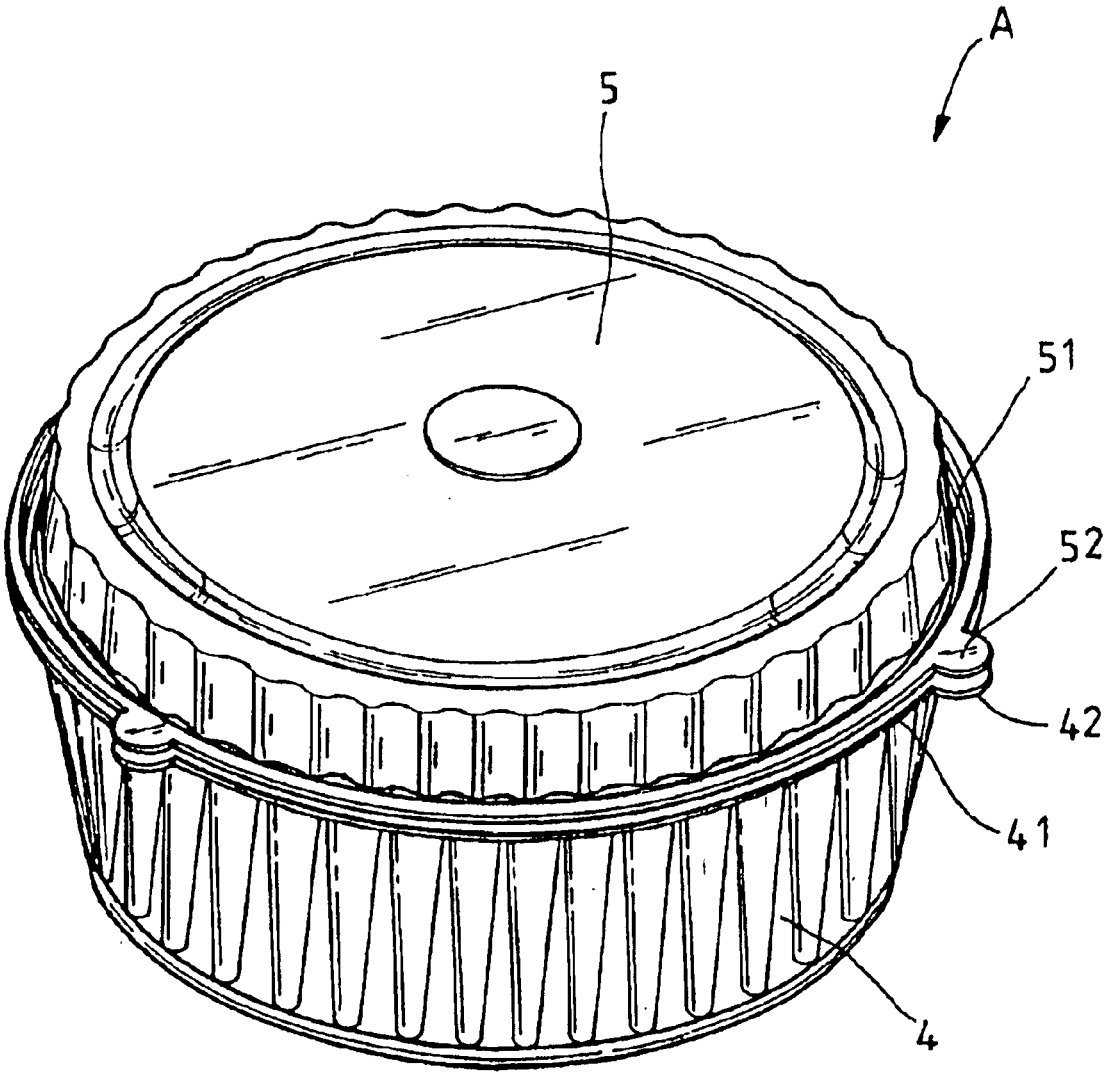
FIG. 6 is an elevational view of the food container of the first embodiment of the present invention, showing the cover closed on the container body.
Figure 9:
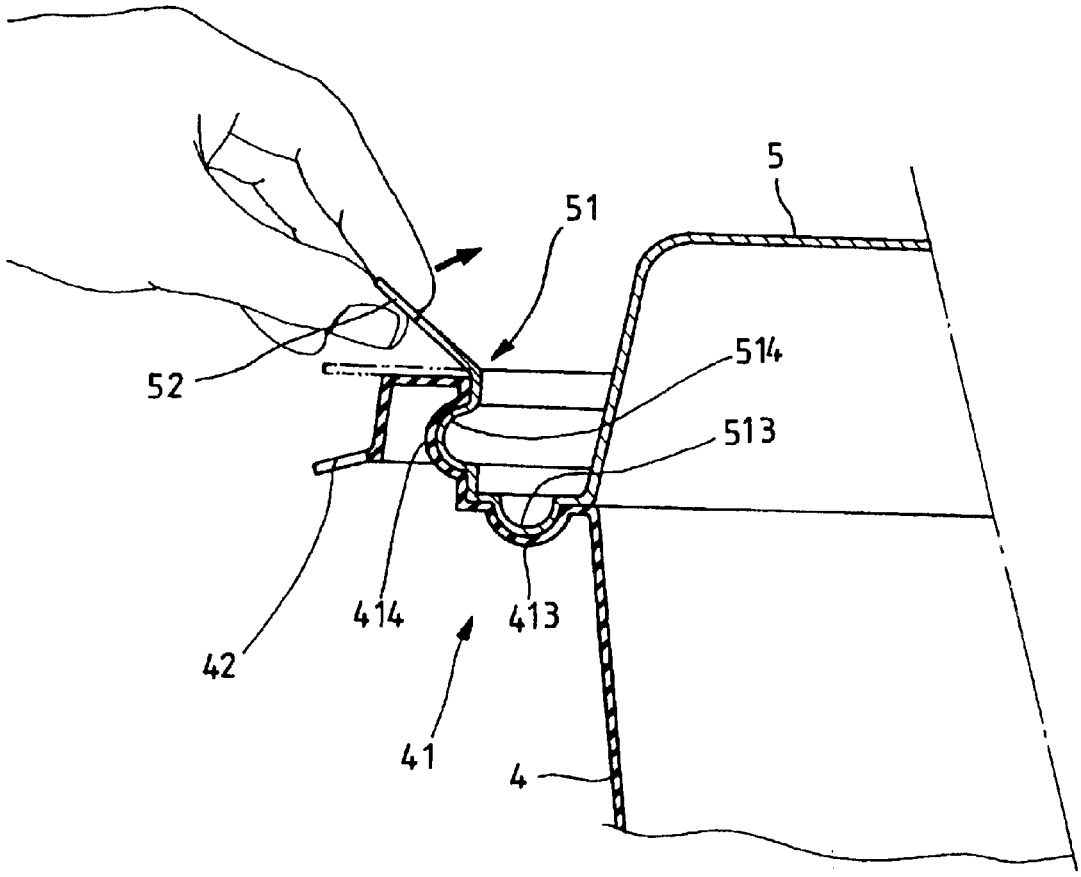
FIG. 9 is a schematic drawing showing a cover opening action according to the present invention.

Referring to FIGS. 5 and 6 again, the container body 4 and the cover 5 each further comprise at least one, for example, a plurality of pull tabs 42 or 52 respectively protruded from the periphery of the respective coupling flange 41 or 51. The pull tabs 42;52 are so arranged that a gap 7 of height approximately equal to the height of the coupling flange 41 or 51 is left between the coupling flange 41 of the container body 4 and the coupling flange 51 of the cover 5. The user can insert the finger into the gap 7 between one pull tab 42 of the container body 4 and the corresponding pull tab 52 of the cover 5 to pull the cover 5 away from the container body 4 conveniently without any tool (see FIG. 9).

After the user opened the cover 5 from the container body 4, the cover 5 is maintained intact, and can be sealed to the container body 4 again in case contained liquid food 43 is not completely eaten up.

In the aforesaid embodiment, the food container A is a round container. Alternatively, the food container can be made in a barrel-like or cup-like shape, or any of a variety of shapes.

Figure 10:
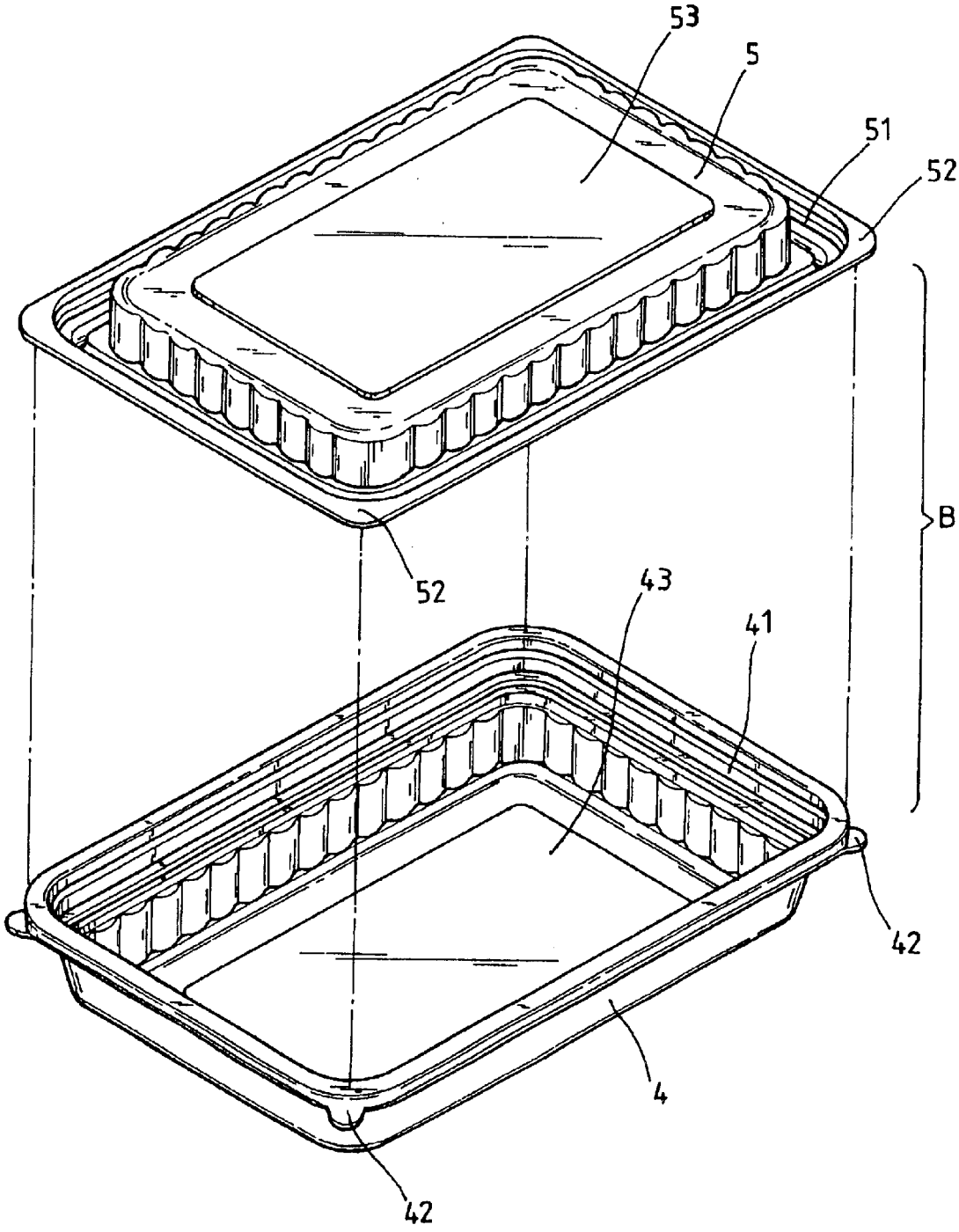
FIG. 10 is an exploded view of a food container according to a second embodiment of the present invention.
Figure 11:
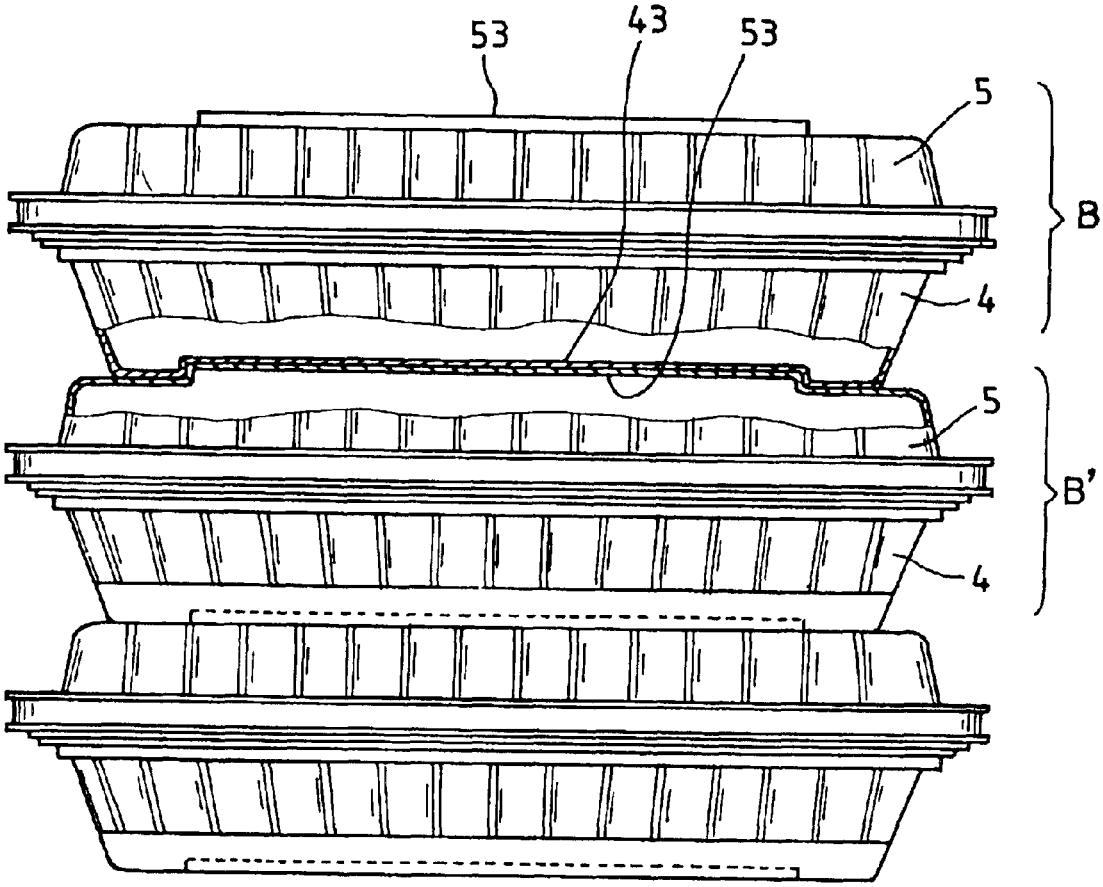
FIG. 11 illustrates a number of food containers arranged in a stack according to the second embodiment of the present invention.

FIGS. 10 and 11 show an alternate form of the present invention. According to this alternate form, multiple food containers B can be arranged in a stack firmly. As illustrated, the bottom sidewall 43 of the container body 4 has a bottom surface curved inwards, and the top sidewall 53 of the cover 5 has a top surface curved outwards. When multiple food containers B are arranged in a stack, the top sidewall 53 of one food container B is engaged into the bottom sidewall 43 of another.

A prototype of food container has been constructed with the features of FIGS. 5~11. The food container functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A food container sealing structure comprising a container body adapted for holding food, said container body having a coupling flange extended around a rim thereof, and a cover adapted for sealing said container body, said cover having a coupling flange extended around a rim thereof and adapted for fastening to the coupling flange of said container body, wherein the coupling flange of said container body comprises a first horizontal section and a first vertical section having a first right angle section formed therebetween, a first endless concave portion formed in the horizontal section of the coupling flange of said container body at an upper side and extended around said container body, said first endless concave portion being respectively bounded by a pair of first horizontally directed planar portions, and a second endless concave portion formed in the first vertical section of the coupling flange of said container body at an inner side and extended around said container body, said second endless concave portion being respectively bounded by a pair of first vertically directed planar portions; the coupling flange of said cover comprises a second horizontal section and a second vertical section having a second right angle section formed therebetween and respectively being in contiguous contact with the first horizontal section and first vertical section of the coupling flange of said container body, said second horizontal section of the coupling flange of said cover having a first endless convex portion formed at a bottom side thereof and extended around said cover and being complementary to the first endless concave portion of said container body, said first endless convex portion being respectively bounded by a pair of second horizontally directed planar portions, and said second vertical section of the coupling flange of said cover having a second endless convex portion formed at an outer side thereof and extending around said cover and being complementary to the second endless concave portion of said container body, said second endless convex portion being respectively bounded by a pair of second vertically directed planar portions, wherein each of said pair of second horizontally directed planar portions, said first endless convex portion, said pair of second vertically directed planar portions, said first right angle section and said second endless convex portion are respectively in contiguous contact with each of said pair of first horizontally directed planar portions, said first endless concave portion, said pair of first vertically directed planar portions, said second right angle section and said second endless concave portion to form a seal between said cover and said container body.

* * * * *